United States Patent [19]

Madden

[11] Patent Number: 4,999,940

[45] Date of Patent: Mar. 19, 1991

[54] WEAPON SAFETY LOCKING APPARATUS

[76] Inventor: Michael T. Madden, 550 Stephenson St., Shrevesport, La. 71104

[21] Appl. No.: 468,197

[22] Filed: Jan. 22, 1990

[51] Int. Cl.[5] ..... F41A 17/44; F41A 17/04

[52] U.S. Cl. ..... 42/70.11

[58] Field of Search ..... 42/70.01, 70.11

[56] References Cited

U.S. PATENT DOCUMENTS

| | | | |
|---|---|---|---|
| 2,327,334 | 8/1943 | Parker | 42/70.11 |
| 2,763,081 | 9/1956 | Huckabee | 42/70.11 |
| 2,887,807 | 5/1959 | Santangelo | 42/70.11 |
| 3,137,957 | 6/1964 | Ingalls | 42/70.11 |
| 3,720,014 | 3/1973 | Goodrich | 42/70.11 |
| 4,136,476 | 1/1979 | Hetrick | 42/70.11 |
| 4,398,366 | 8/1983 | Wernicki | 42/70.11 |
| 4,835,894 | 6/1989 | Libassi | 42/70.11 |

*Primary Examiner*—Michael J. Carone

*Attorney, Agent, or Firm*—Andsel Group, Inc.

[57] ABSTRACT

A weapon safety locking apparatus that has a flexible, longitudinally adjustable, locking rod, a chamber insert connected to one end of the rod and a breech block connected to the chamber insert. The apparatus has a locking means to lock the rod within the barrel of a weapon and a plurality of locking knuckles on the rod that the locking means grips when the locking means is in locking engagement with the rod. There is a muzzle cap an a chamber insert that have a tapered end to enable the apparatus to be used on various sizes of firearms. The locking rod, muzzle cap and chamber insert are made of a plastic material. The plastic material of the muzzle cap and the chamber insert has a surface with a low surface hardness to protect the muzzle and the chamber. The plastic material of the muzzle cap is elastically deformable and will return to its originally formed shape. The rod is inserted into the chamber and through the bore of the barrel. The part of the rod extending beyond the barrel receives the locking means. Once the rod is inserted into the bore and the locking means is locked to the rod, the muzzle cap and the chamber insert limit access to the bore of the barrel, help prevent the weapon from being loaded and reduce the chance of unauthorized firing of the weapon.

7 Claims, 1 Drawing Sheet

WEAPON SAFETY LOCKING APPARATUS

BACKGROUND OF THE INVENTION

1. Field of the Invention

This invention relates to a weapon safety locking apparatus for portable firearms such as pistols, rifles and shotguns. The apparatus is easily placed into the weapon and is convenient to use in the field to help prevent the weapon from being loaded and to help prevent unauthorized firing of the weapon.

2. Description of the Related Art

Current weapons security is generally limited to placing weapons out of a child's reach, locking the weapon in a gun cabinet or drawer and separating the bolt and ammunition from the rest of the weapon. Several safety devices have been disclosed showing various inserts and locks to prevent insertion of a live round. None of these provided a simple, easy to use means to prevent unauthorized use of the weapon that is easily adaptable to most portable firearms without requiring the user to carry a number of adapters to accommodate the various firearms at hand in the field.

U.S. Pat. No. 2,763,081 to J. M. Huckabee on Sept. 18, 1956 describes a gun barrel sealing device with a plug that fits into the chamber, a rod and a cap that fits over the end of the barrel. The rod can only be removed from the barrel, once in place, by a special spanner wrench.

U.S. Pat. No. 2,887,807 to C. L. Santangelo on May 26,1959 shows a firearm locking device consisting of a locking rod with an eccentric cam end that rotates and locks within a cartridge-shaped insert placed within the chamber.

U.S. Pat. No. 3,137,957 to B. W. Ingalls on June 23, 1964 shows a device consisting of a flexible coated cable with a lock at one end and a tip at the other end designed to fit into the chamber of a specific firearm.

U.S. Pat. No. 4,136,476 to George Hetrick on Jan. 30, 1979 describes a safety device having a metallic rotatable cartridge plug, a telescopic rod threaded into a plug and a cap on the end of the plug larger than the bore of the gun. The rod can only be removed by pulling while simultaneously turning the rod to unthread it from the plug.

SUMMARY OF THE INVENTION

The invention is a apparatus which when locked in place will render a weapon difficult to load and fire accidentally. The apparatus reduces the chance of unauthorized usage of the firearm. By locking the breech, barrel and muzzle, the weapon is incapacitated and cannot be fired until the safety locking apparatus is removed. The apparatus is capable of being used for single shot, semi and full automatic rifles, pistols and for shotguns of all sizes and calibers. If desired, the length of the locking rod may be adjusted by cutting off a portion of the rod to custom fit a particular weapon. However, the locking rod may be used, even at its longest length, in a short barreled weapon such as a pistol and the excess may extend beyond the muzzle. The locking means will lock on the locking rod along most of the length of the rod since locking knuckles are provided along most or all of the length of the rod. One of the advantages of this apparatus is that the rod, muzzle cap and chamber insert are made entirely of a plastic material such as nylon, teflon and suitable petrochemical and hydrocarbon based plastics and do not present a metal or other abrading surface that might harm the weapon as other previous locking devices, with only a plastic coating, might do if the plastic coating were to wear off. In the instant invention, the leading end of the bolt may rest on the rear surface of the breech block without damaging the bolt mechanisms. Allowing the bolt to rest on the rear surface of the breech block allows the spring means that activates the forward motion of the bolt to rest and therefore reduces wear of the spring means. Previous safety devices do not offer such a feature. This is especially important for semi and fully automatic weapons.

In operation, the locking rod is inserted into the chamber and through the bore of the barrel until the tapered end of the chamber insert is snug against the chamber with a portion of the taper in the chamber. A portion of the locking rod will extend beyond the muzzle of the barrel. The breech block will stick out at an angle from the chamber and limit the movement of the breech action and reduce the chance of placing a round in the chamber. The looking means, such as a tumbler look as shown in the drawings, has a longitudinal port through the center of the lock. The looking rod is passed through the port and muzzle cap snugly placed against the muzzle with a portion of the tapered end in the bore of the barrel. The plastic material of the muzzle cap is an elastically deformable plastic with a memory that reforms the cap back to its original form when the tapered end of the cap is swaged into the bore of the barrel through the muzzle to help seal off the bore from dust and other debris and to reduce the movement of the rod within the barrel. Reduction of movement of the rod within the barrel helps to reduce the chance that rod movement or vibration would abrade the bore or other parts of the firearm. The locking means is then locked onto the rod as the locking shackles within the locking means grip the rod at the locking knuckles on the locking rod thus preventing the locking means from being removed without excessive force. Removal is accomplished by reversing these steps.

A weapon safety locking apparatus is described that is used on a firearm that has a chamber, a firing mechanism, a bolt, a breech, a barrel, a bore in the barrel and a muzzle on the barrel. The weapon safety locking apparatus has a flexible longitudinally adjustable locking rod and a chamber insert connected to one end of the rod. There is a locking means to lock the rod in the barrel and a plurality of locking knuckle means on the rod that the locking means grips when the locking means is in a locking engagement with the rod.

There is a muzzle cap with one end intimately engaged with the locking means to limit access to the bore of the barrel from the muzzle of the barrel, a taper on one end of the chamber insert that intimately engages the chamber to limit access to the chamber, a port in the muzzle cap and a taper on the other end on the muzzle cap that intimately engages the muzzle of the barrel.

The weapon safety locking apparatus may have a breech block connected to the chamber insert. The breech block may have a flat rear surface upon which a leading edge of the bolt may rest. The locking rod, the insert and the breech block may be made of a plastic material. The plastic material of the muzzle cap may be elastically deformable and which allows the plastic material of the muzzle cap to return to a predetermined shape. There may be a surface on the taper of the chamber insert having a low surface hardness to reduce abrasion to the chamber and to reduce impact damage on the firing mechanism should the firing mechanism impact the chamber insert.

It is therefore an object of this invention to provide a weapon safety locking apparatus that is simple and easy to use.

It is another object of this invention to provide a weapon safety locking apparatus that may be placed on a variety of firearms of varying sizes and calibers including rifles, pistols and shotguns either single shot, semi or full automatic.

It is yet another object of this invention to provide a weapon safety locking apparatus that will not mar the firing surfaces of the firearm.

DESCRIPTION OF THE PREFERRED EMBODIMENT

Figure 1:
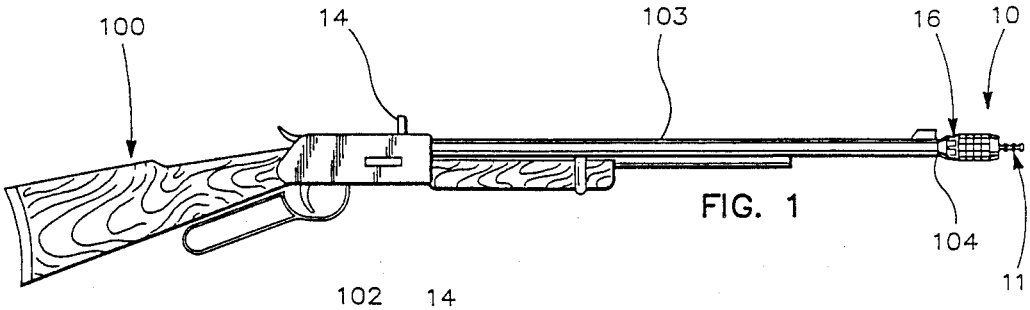
FIG. 1. is a side elevational view of a rifle with the weapon safety locking apparatus locked in place.
Figure 2:
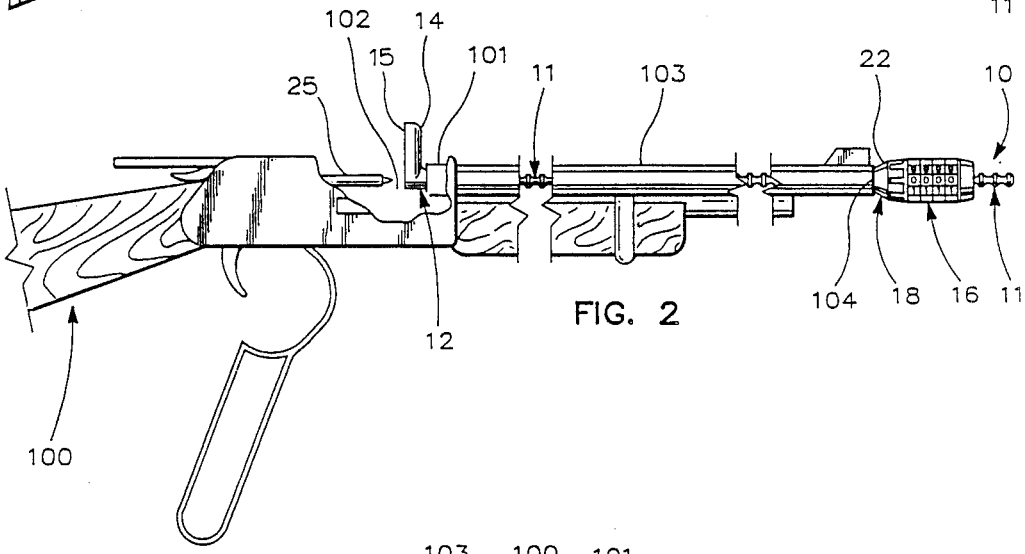
FIG. 2 is a partial, fragmented side elevational view showing the safety locking apparatus in progressive parts of the weapon.
Figure 3:
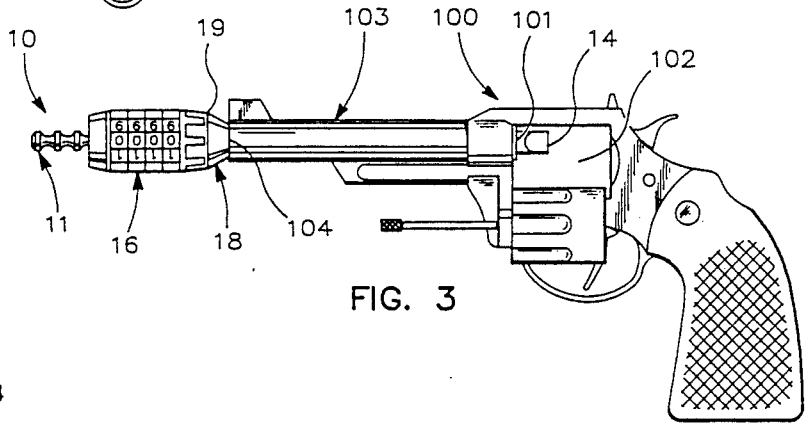
FIG. 3 is a side elevational view of a pistol with the safety locking apparatus locked in place.
Figure 4:
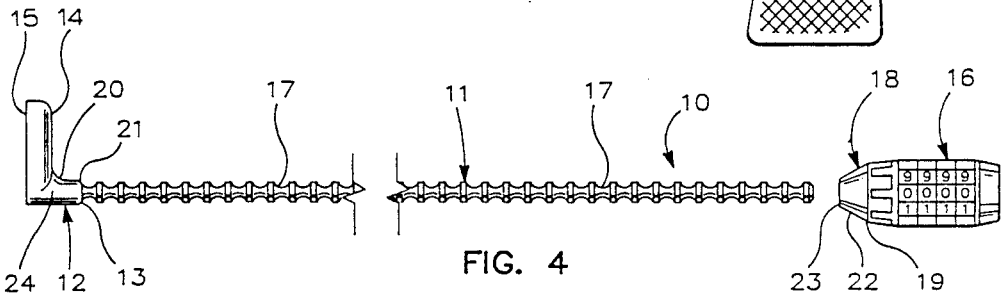
FIG. 4 is a side elevational view of the weapon safety locking apparatus showing the tumbler locking means separated from the locking rod.

In FIGS. 1,2,3 and 4, is shown a weapon safety locking apparatus 10. A weapon safety locking apparatus 10 for a firearm 100, the firearm 100 having a chamber 101, a firing mechanism (not shown), a breech 102, a barrel 103, a bore (not shown) in the barrel and a muzzle 104 on the barrel 103.

The weapon safety locking apparatus 10 has a flexible, longitudinally adjustable, locking rod 11. There is a chamber insert 12 connected to one end 13 of the rod 11 and a breech block 14 connected to the chamber insert 12. The rod 11, the insert 12 and the breech block 14 are made of a plastic material. The muzzle cap 18 is made of an elastically deformable plastic material that with a cap that may be swaged down into the bore and return to its original shape when removed. There is a locking means 16, such as the tumbler lock 16 shown in the drawings. Other locking means could be adapted for use.

There are a plurality of locking knuckles means 17 on the locking rod 11 that the locking means 16 grips when the locking means 16 is in locking engagement with the rod. There is a muzzle cap 18 with one end 19 intimately engaged with the locking means 16 to limit access to the bore (not shown) of the barrel 103 from the muzzle 104 of the barrel 103.

There is a taper 20 on one end 21 of the chamber insert 12 that intimately engages the chamber 101 to limit access to the chamber 101. There is a port (not shown) in the muzzle cap 18 and a taper 22 on the other end 23 on the muzzle cap 18 that intimately engages the muzzle 104 of the barrel 103. A surface 24 on the taper 20 of the chamber insert 12 has a low surface hardness to reduce abrasion to the chamber 101 and to reduce impact damage on the firing mechanism should the firing mechanism impact the chamber insert 12.

The plastic material of the muzzle cap 18 is elastically deformable and which allows the plastic material of the muzzle cap 18 to return to a predetermined shape. Such a plastic material would provide a surface with a surface hardness less than the surface hardness of the chamber 101 or muzzle 104 of a firearm 100 to reduce abrasion or other damage to the firearm. There is a flat rear surface 15 on the breech block 14 upon which a leading edge (not shown) of the bolt 25 may rest. By allowing the leading edge of the bolt to rest on flat surface 15, the spring means (not shown) that drives the bolt 25 forward is allowed to be at rest relieving the spring tension and reducing wear on the spring means and other parts (not shown) of the firing mechanism (not shown).

The foregoing descriptions and drawings of the invention are explanatory and illustrative only, and various changes in shape, sizes and arrangements of parts as well certain details of the illustrated construction may be made within the scope of the appended claims without departing from the true spirit of the invention.

I claim:

1. A weapon safety locking apparatus for a firearm having a chamber, a firing mechanism, a bolt, a breech, a barrel, a bore in the barrel and a muzzle on the barrel comprising:

a. a flexible longitudinally adjustable locking rod;
b. a chamber insert connected to one end of the rod;
c. a locking means to lock the rod in the barrel;
d. a plurality of locking knuckle means on the rod that the locking means grips when the locking means is in a locking engagement with the rod;
e. a muzzle cap with one end intimately engaged with the locking means to limit access to the bore of the barrel from the muzzle of the barrel;
f. the muzzle cap being made of a elastically deformable plastic material that returns to a predetermined shape;
g. a taper on one end of the chamber insert that intimately engages the chamber to limit access to the chamber;
h. a port in the muzzle cap; and
i. a taper on the other end on the muzzle cap that intimately engages the muzzle of the barrel.

2. A weapon safety locking apparatus as described in claim 1 further comprising a breech block connected to the chamber insert.

3. A weapon safety locking apparatus as described in claim 1 further comprising the locking rod, the insert and the breech block being made of a plastic material.

4. A weapon safety locking apparatus as described in claim 1 wherein the breech block further comprises a flat rear surface upon which a leading edge of the bolt may rest.

5. A weapon safety locking apparatus as described in claim 1 further comprising a surface on the taper of the chamber insert having a low surface hardness to reduce abrasion to the chamber and to reduce impact damage on the firing mechanism should the firing mechanism impact the chamber insert.

6. A weapon safety locking apparatus for a firearm having a chamber, a firing mechanism, a bolt, a breech, a barrel, a bore in the barrel and a muzzle on the barrel comprising:

a. a flexible longitudinally adjustable locking rod;
b. a chamber insert connected to one end of the rod;
c. a locking means to lock the rod in the barrel;
d. a plurality of locking knuckle means on the rod that the locking means grips when the locking means is in a locking engagement with the rod;
e. a muzzle cap with one end intimately engaged with the locking means to limit access to the bore of the barrel from the muzzle of the barrel;

f. a taper on one end of the chamber insert that intimately engages the chamber to limit access to the chamber;

g. a port in the muzzle cap;

h. a taper on the other end on the muzzle cap that intimately engages the muzzle of the barrel;

i. a surface on the taper of the chamber insert having a low surface hardness to reduce abrasion to the chamber and to reduce impact damage on the firing mechanism should the firing mechanism impact the chamber insert, and j. the plastic material of the muzzle cap being elastically deformable allowing the plastic material of the muzzle cap to return to a predetermined shape.

7. A weapon safety locking apparatus for a firearm having a chamber, a firing mechanism, a bolt, a breech, a barrel, a bore in the barrel and a muzzle on the barrel comprising:

a. a flexible longitudinally adjustable locking rod;

b. a chamber insert connected to one end of the rod;

c. a breech block connected to the chamber insert;

d. a flat rear surface on the breech block upon which a leading edge of the bolt may rest;

e. the rod, the insert and the breech block being made of a plastic material;

f. a locking means to lock the rod in the barrel;

g. a plurality of locking knuckle means on the rod that the locking means grips when the locking means is in a locking engagement with the rod;

h. a muzzle cap with one end intimately engaged with the locking means to limit access to the bore of the barrel from the muzzle of the barrel;

i. a taper on one end of the chamber insert that intimately engages the chamber to limit access to the chamber;

j. a port in the muzzle cap;

k. a taper on the other end on the muzzle cap that intimately engages the muzzle of the barrel;

l. a surface on the taper of the chamber insert having a low surface hardness to reduce abrasion to the chamber and to reduce impact damage on the firing mechanism should the firing mechanism impact the chamber insert, and m. the plastic material of the muzzle cap being elastically deformable and having a memory allowing the plastic material of the muzzle cap to return to a predetermined shape.

* * * * *